United States Patent [19]

Phillips et al.

[11] Patent Number: 4,730,195

[45] Date of Patent: Mar. 8, 1988

[54] SHORTENED WIDEBAND DECOUPLED SLEEVE DIPOLE ANTENNA

[75] Inventors: James P. Phillips, Lake in the Hills; Henry L. Kazecki, DesPlaines, both of Ill.

[73] Assignee: Motorola, Inc., Schaumburg, Ill.

[21] Appl. No.: 750,633

[22] Filed: Jul. 1, 1985

[51] Int. Cl.[4] ..... H01Q 9/18

[52] U.S. Cl. ..... 343/792; 343/794; 343/802; 343/822; 343/727; 343/749; 343/895

[58] Field of Search ..... 343/792, 793, 791, 790, 343/794, 796, 801, 802, 822, 749, 751, 752, 722, 725, 726, 727, 715, 702, 895

[56] References Cited

U.S. PATENT DOCUMENTS

| | | | |
|---|---|---|---|
| 2,996,718 | 8/1961 | Foley | 343/827 X |
| 3,031,668 | 4/1962 | Bryson | 343/790 |
| 3,523,297 | 8/1970 | Fee | 343/729 X |
| 3,611,402 | 10/1971 | Thomas et al. | 343/861 |
| 3,624,662 | 11/1971 | Feder | 343/715 |
| 3,656,167 | 4/1972 | Lea | 343/860 X |
| 3,720,874 | 3/1973 | Gorcik et al. | 343/841 X |
| 3,774,221 | 11/1973 | Francis | 343/749 |
| 3,946,397 | 3/1976 | Irwin | 343/788 |
| 3,981,017 | 9/1976 | Kommrusch | 343/792 |
| 4,087,820 | 5/1978 | Henderson | 343/895 X |
| 4,097,870 | 6/1978 | Fulmer, Sr. et al. | 343/792 |
| 4,117,493 | 9/1978 | Altmayer | 343/715 X |
| 4,121,218 | 10/1978 | Irwin et al. | 343/702 |
| 4,138,681 | 2/1979 | Davidson et al. | 343/702 |
| 4,161,737 | 7/1979 | Albright | 343/749 |
| 4,167,011 | 9/1979 | Altmayer | 343/722 X |
| 4,205,319 | 5/1980 | Gasparaitis et al. | 343/792 |
| 4,229,743 | 10/1980 | Vo et al. | 343/895 X |
| 4,247,858 | 1/1981 | Eichweber | 343/729 |
| 4,313,119 | 1/1982 | Garay et al. | 343/702 |
| 4,352,109 | 9/1982 | Reynolds et al. | 343/792 |
| 4,376,941 | 3/1983 | Zenel | 343/895 X |
| 4,442,438 | 4/1984 | Siwiak et al. | 343/792 |
| 4,494,122 | 1/1985 | Garay et al. | 343/722 |
| 4,504,834 | 3/1985 | Garay et al. | 343/749 |

FOREIGN PATENT DOCUMENTS

| | | | |
|---|---|---|---|
| 1937633 | 2/1971 | Fed. Rep. of Germany | 343/792 |

*Primary Examiner*—Eugene R. LaRoche
*Assistant Examiner*—Benny T. Lee
*Attorney, Agent, or Firm*—Raymond A. Jenski; Rolland R. Hackbart

[57] ABSTRACT

A shortened wideband decoupled sleeve dipole antenna is disclosed in which a helically wound upper radiating element and an inductively loaded lower radiating sleeve element reduce the linear size of the antenna. Substantial decoupling is provided by a helically wound feed coaxial transmission line within the sleeve element. A matching network at the antenna feed point provides capacitive reactance above the antenna resonant frequency and inductive reactance below the antenna resonant frequency such that an impedance match between the feed coaxial transmission line is obtained at frequencies above and below the resonant frequency and dual-band performance may be obtained.

14 Claims, 20 Drawing Figures

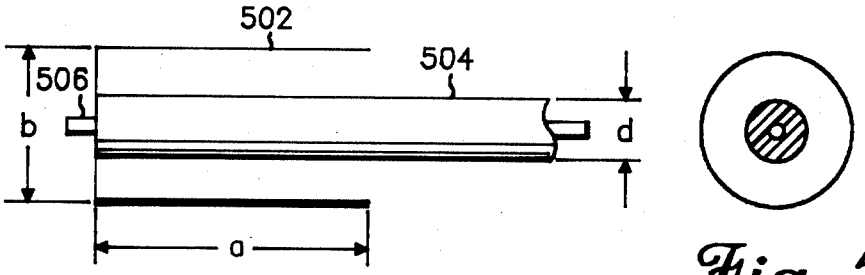
Fig. 5
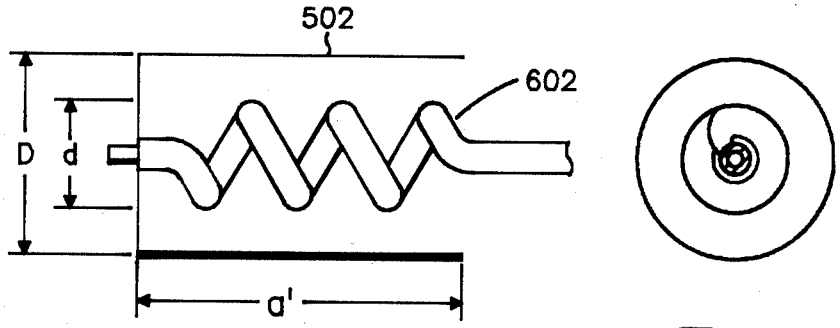
Fig. 6
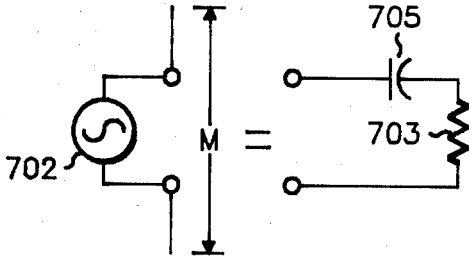
Fig. 7
Fig. 8
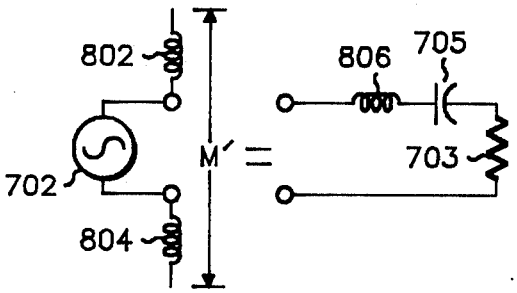
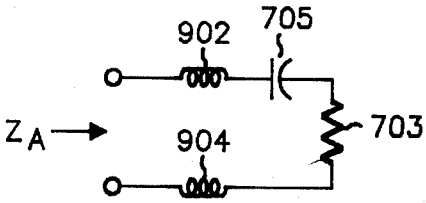
Fig. 9

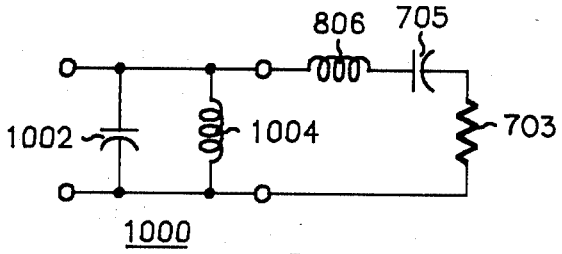
Fig. 10
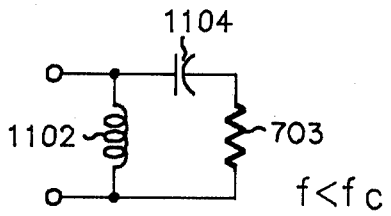
Fig. 11
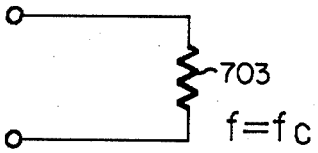
Fig. 12
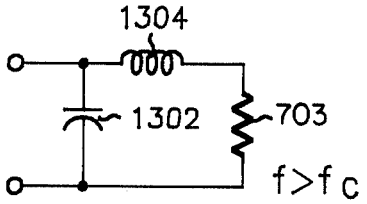
Fig. 13
Fig. 14
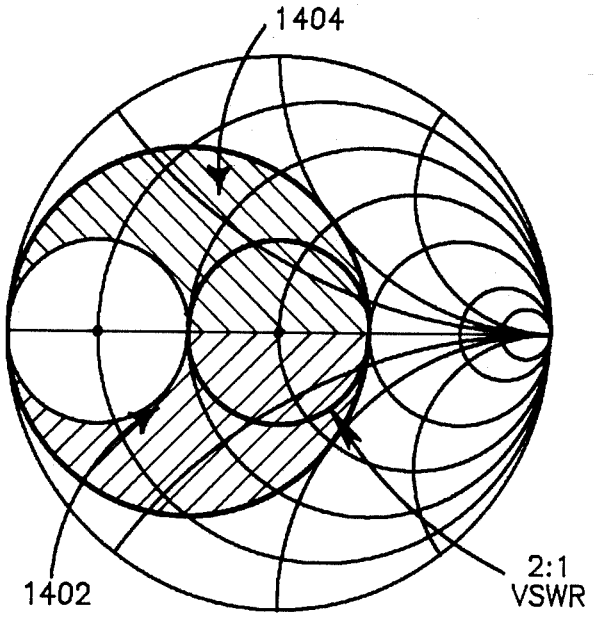
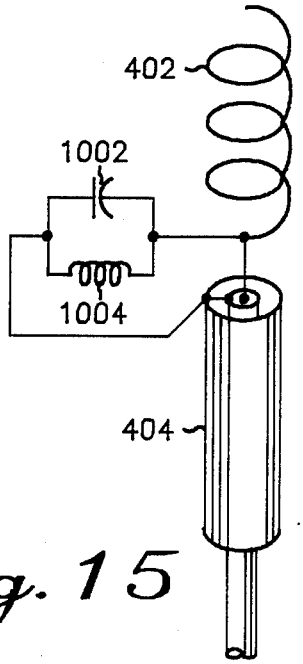
Fig. 15

SHORTENED WIDEBAND DECOUPLED SLEEVE DIPOLE ANTENNA

BACKGROUND OF THE INVENTION

This invention relates generally to the field of antenna structures for radio communications equipment and more particularly to a shortened decoupled wideband sleeve dipole antenna flexibly realized for use in duplex portable radio applications.

It is well established in the field of antennas that a quarter wavelength monopole mounted perpendicularly to a conducting surface provides an antenna having good radiation characteristics, desirable drive point impedance, and relatively simple construction. Such antennas have been disclosed in U.S. Pat. Nos. 3,611,402 and 3,624,662 assigned to the assignee of the present invention. The necessity of a conducting surface makes monopole antennas an attractive choice for mobile applications where the metallic body of a vehicle serves particularly well as a ground plane conducting surface. Monopoles have also been employed as antennas for hand-held portable transceivers, such as referenced in U.S. Pat. No. 4,121,218 assigned to the assignee of the present invention, but the detuning and absorbtive effects of the user's body have indicated that monopole antennas are not particularly suited for portable applications.

Additionally, if the transceiver is to be operated in a duplex mode—that is, the transmitter and receiver operating simultaneously—the relatively high power radio frequency currents present in the metallic chassis of the transceiver when used with a monopole antenna tend to disrupt the operation of the receiver. One solution to this problem found in duplex operation is disclosed in U.S. Pat. No. 4,138,681 assigned to the assignee of the present invention, in which currents in the chassis of the portable are reduced by employing antenna radiating elements decoupled from the portable chassis.

A solution to the ground plane requirement of the monopole antenna is the use of a dipole antenna. This solution is also quite well known and commonly employed at VHF and UHF frequencies. One such antenna structure for portable transceiver equipment was disclosed in U.S. Pat. No. 4,205,319 assigned to the assignee of the present invention. Half-wave dipoles, however, are physically large when compared to the relatively small portable transceiver. Such large dipoles are both aesthetically displeasing and cumbersome to the user of miniature portable transceivers.

Reduction of the physical size of portable transceiver antennas has generally been achieved by employing helically wound radiators for one element of the dipole (see U.S. Pat. Nos. 3,720,874 and 4,504,834 assigned to the assignee of the present invention) or for both elements of the dipole (see U.S. Pat. No. 4,442,438 assigned to the assignee of the present invention). Physical size reduction, however, reduces the operating bandwidth of the antenna (generally recognized as the frequencies at which the return loss is greater than −10 dB) because of changes in the input impedance.

Since a duplex portable transceiver typically requires at least one frequency for radio frequency signal transmission and at least one different frequency for radio frequency signal reception, the antenna should include both frequencies within its operating bandwidth. The requirement is further complicated if the portable transceiver is to be used in a cellular radiotelephone system where a multitude of frequencies in one band are potentially useable for transmission and a multitude of frequencies in another band are potentially useable for reception. The antenna for a cellular portable radiotelephone, then, must either have a very broad bandwidth or have two bands of operating bandwidth to function properly with the portable. Broadband or dual bandwidth antennas have been realized in several recent inventions (see U.S. Pat. No. 4,442,438,4,494,122; and 4,571,595, each assigned to the assignee of the present invention). Generally, these antennas are physically longer and stiffer than desirable in a portable cellular radiotelephone and leave a need which can be fulfilled by the present invention.

SUMMARY OF THE INVENTION

Therefore, one object of the present invention is to enable efficient operation of a portable transceiver antenna at two separate frequencies.

A further object of the present invention is to decouple the antenna from the housing of the transceiver so that antenna derived radio frequency currents on the housing are small and therefore have little effect on the performance of the radio transceiver and antenna.

A further object of the present invention is to reduce the physical size of the antenna consistent with the size of the transceiver.

A further object of the present invention is to obtain physical flexibility of the antenna structure such that conditions present in a portable transceiver environment do not result in premature failure of the antenna.

Accordingly, these and other objects are realized in the shortened wideband dipole antenna of the present application. The invention described herein is a wideband shortened decoupled sleeve dipole antenna primarily for portable radio transceivers. The antenna employs a helically wound first radiating element mounted vertically above a cylindrical sleeve second radiating element and has a feed point where the first and second radiating elements come together. The radiating elements are tuned to be resonant at a center resonant frequency. A matching network, tuned to the center resonant frequency and placed at the feedpoint, provides reactive impedance components at frequencies above and below the center resonant frequency. These components match the antenna elements to a feed coaxial transmission line at predetermined frequencies above and below the center resonant frequency. The feed coaxial line is helically wound within the cylindrical sleeve second radiating element, coupled to the feed point at one end, and emanating from the cylindrical sleeve at the other end where a signal source or sink may be attached.

BRIEF DESCRIPTION OF THE DRAWINGS

FIG. 5 is a drawing of a conventional sleeve decoupling element.

FIG. 6 is a drawing of a shortened sleeve decoupling element which may advantageously be used by the present invention.

FIG. 7 is a schematic representation of a shortened dipole antenna.

FIG. 8 is a schematic representation of a shortened dipole antenna resonated by inductive loading.

FIG. 9 is a schematic diagram of the electrical model of a shortened dipole sleeve antenna such as that of the present invention.

FIG. 10 is a schematic diagram of the electrical model of a shortened dipole sleeve antenna and matching network which may be employed in the present invention.

FIG. 11 is a schematic diagram of the electrical model of FIG. 10 operated at a frequency below the center resonant frequency.

FIG. 12 is a schematic diagram of the electrical model of FIG. 10 operated at the center resonant frequency.

FIG. 13 is a schematic diagram of the electrical model of FIG. 10 operated at a frequency above the center resonant frequency.

FIG. 14 is a Smith chart illustrating antenna impedances which may be converted to a 2:1 VSWR by the matching network of FIG. 10.

FIG. 15 is a representation of the electrical location of the matching network of FIG. 10 in the antenna of the present invention.

DETAILED DESCRIPTION OF THE PREFERRED EMBODIMENT

Figure 1:
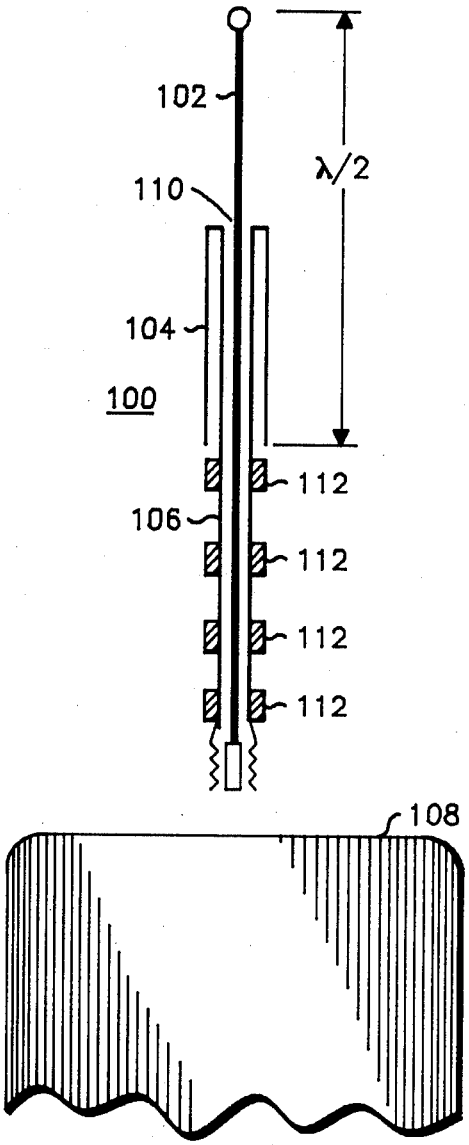
PRIOR ART Fig. 1
FIG. 1 is a simplified diagram of a conventional decoupled sleeve dipole antenna.

A radio antenna, generally, is a structure associated with a region of transition between a guided transmission line wave and a free space wave. A typical antenna that makes this transition for a portable radio transceiver is a sleeve dipole radiator such as that shown in FIG. 1. The antenna 100 is comprised of a quarter wave radiator element 102 and a quarter wave sleeve radiator 104. A coaxial cable 106 guides radio frequency (RF) energy from a portable transceiver 108 to the radiator 102 and sleeve 104. The point of transition from the coaxial 106 to the radiator element 102 and sleeve 104 is known as the antenna feed point and is generally located at the junction of the two radiators as shown as 110 in the diagram of FIG. 1. From the feed point 110, the sleeve radiator 104 is folded back on the coaxial cable 106 and insulated from the coaxial cable 106 at all points except for the feed point 110 where the sleeve 104 is connected to the outer conductor of the coaxial cable 106. A second transmission line is thus formed between sleeve 104 and the outer conductor of coaxial cable 106 having a predetermined characteristic impedance related to the geometries of the sleeve and coaxial cable. The radiator element 102 is connected to the center conductor of coaxial cable 106 at the feed point 110 and is oriented in a direction that is essentially 180° from the direction of the sleeve 104. The overall length of the radiator element 102 and sleeve 104 is typically a half-wavelength of the operating frequency (shown as lambda/2 in FIG. 1) and, at a frequency of 850 MHz, is approximately 6.9 inches.

Reduction of RF energy returning on the outer conductor of coax 106 may be accomplished by appropriate placement of lossy material such as the powdered iron rings 112 encircling the coaxial cable 106 in FIG. 1. These ferrite rings 112 decouple the antenna from the portable transceiver 108 and help prevent undesirable interaction between the antenna and the portable transceiver 108 housing. Interaction may occur at both the transmitter frequency or the receiver frequency if the portable transceiver operates at two frequencies.

In general, antenna performance is evaluated in terms of the following parameters: Feed point impedance, far-field radiation pattern, and E-field polarization. The E-field polarization is fixed by the system antenna configuration and orientation in space and in practically all radiotelephone systems is vertical polarization. For best reception of a vertically polarized signal, the receiving antenna should have the same polarization as the transmitting antenna, otherwise the receiving antenna will be cross polarized and may experience approximately 20 dB loss of signal. The vertical dipole structure shown in FIG. 1 produces vertically polarized radiation and is commonly used.

Figure 2:
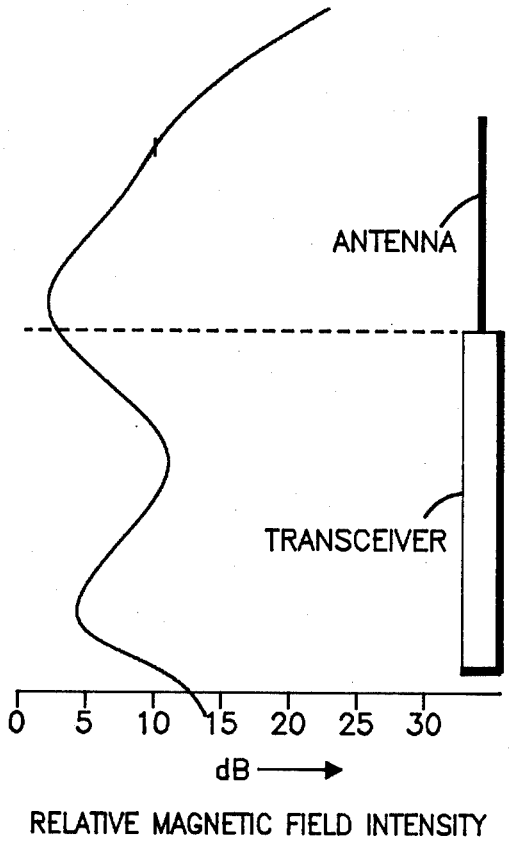
FIG. 2 is a graph showing the magnetic field intensity of a portable transmitter and an antenna such as that of FIG. 1.

The far-field radiation pattern is an important antenna characteristic showing effectiveness and direction of electromagnetic energy radiation. For the dipole antenna in free space, an extensive body of theoretical and experimental data is available for prediction of the radiation pattern for most antenna configurations. Portable transceiver antennas, alone, may be accurately characterized by theoretical models. However, the proximity of the radio housing without sufficient antenna decoupling distorts the characteristics of the antenna and degrades the far field radiation pattern. Additionally, RF signal currents flowing in the housing of the radio may disrupt the proper operation of a simultaneously operating receiver. A graph of the magnetic field intensity of the transmitted energy from a portable transceiver, indicative of the RF signal currents flowing on the antenna and transceiver housing, is shown in FIG. 2. In this situation, where the antenna is improperly decoupled from the radio housing, a substantial amount of current flows in the radio housing which is shown by the magnetic field intensity corresponding in space to the lower half of the radio housing. The intensity at this point is less than 2 dB below the peak magnetic field intensity corresponding in space to the base of the antenna and yields unacceptable performance in operation of the portable transceiver.

The antenna driving point impedance is of considerable importance, especially when the antenna is used to transmit energy. The quality of match between the driving point impedance and the transmission line determines the resulting standing waves on the transmission line; high standing waves degrade the transmission efficiency and increase losses. The resistive component of the feed point impedance consists of the radiation resistance of the antenna and the conductor resistance of the materials of the antenna. The radiation resistance is essentially a result of the distribution of current on the radiating elements of the antenna. Its value varies along the length of the antenna and at the end points is theoretically infinite (although fringing and non-zero current reduces it to a few kilohms) and, for a half-wave dipole antenna, is approximately 73 ohms with near-zero reactance (at the frequency at which the antenna is a half wave dipole) at the antenna feed point. The half-wave dipole has a relatively large radiation resistance and a negligibly small conductor resistance. However, for shortened antennas, the two components of the feed point resistance can be comparable and result in a feed point resistance much lower than 73 ohms. Feed point resistance can, therefore, become the limiting factor in radiation efficiency of shortened antennas.

The true half-wave dipole is a balanced antenna and must be driven from a balanced transmission line. Virtually every portable transmitter output is an unbalanced output driving an unbalanced coaxial line. The true dipole, therefore, requires a matching interface or unbalanced to balanced transformer balun. In most instances, the matching interface is implemented as an integral part of the antenna. Portable transceiver antennas typically use the lower radiator section of the antenna to accomplish the matching in a manner which essentially folds the outer conductor of the coaxial cable back over itself such that a decoupling sleeve is formed. Such an antenna was shown diagrammatically in FIG. 1. The transformation from unbalanced to balanced feed is accomplished by appropriate design of the sleeve dimensions to eliminate currents flowing on the feed coaxial cable. This antenna driving arrangement is optimum and compatible with portable transceiver form factors although, as noted, results in an antenna of objectionable length.

Figure 3:
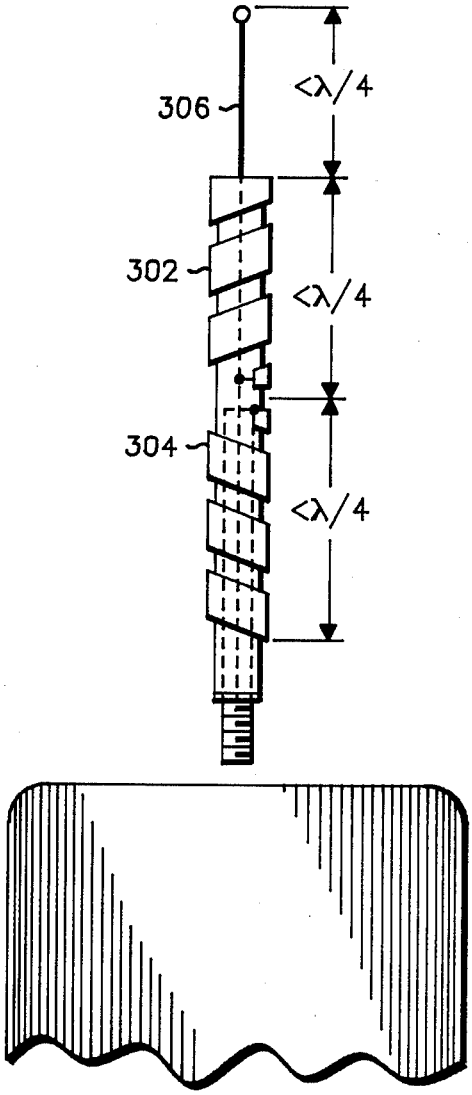
PRIOR ART Fig. 3
FIG. 3 is a simplified diagram of one typical shortened dipole antenna.
Figure 4:
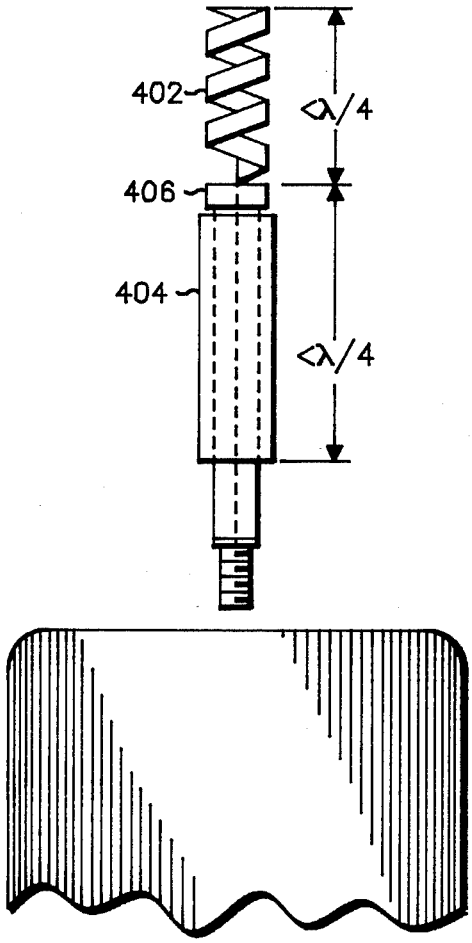
FIG. 4 is a simplified diagram of the shortened decoupled sleeve dipole antenna of the present invention.

One solution to the antenna length problem is to form the radiator element and the decoupling sleeve into helices which, at resonance, are electrically a half-wavelength in length while occupying substantially less physical length than a half-wavelength. Such a helical antenna structure is shown in FIG. 3. The radiating element 302 and the conductive sleeve element 304 may be helically wound on a predetermined diameter dielectric such as each element is smaller than a quarter wavelength. A helical antenna structure, however, has a substantially narrower bandwidth and more rapidly changing feed point impedance with frequency than the equivalent decoupled half-wave dipole antenna. In order to overcome this narrow banding in previous implementations, a linear radiator 306 has been extended beyond the helically wound radiator 302, colinear with the helical radiator 302, and connected to the antenna feed point. This antenna is further described in U.S. Pat. No. 4,442,438 assigned to the assignee of the present invention. The antenna of the present invention, which is shown diagrammatically in FIG. 4, reduces the length of the antenna beyond that achieved in previously known configurations by helically winding the radiator 402, inductively loading the radiating decoupling sleeve 404, and matching the antenna feed point impedance with a broad band matching network 406. This novel antenna realizes a 7.5% bandwidth in a half-wave sleeve dipole configuration that is 20% smaller than other half-wave dipoles.

The antenna of the preferred embodiment is to operate with a portable radiotelephone transceiver capable of duplex transmission and reception in two separate frequency bands of 825 MHz to 845 MHz and 870 MHz to 890 MHz. The bandwidth requirement for this type of operation is considered to be the total frequency band including the between band separation for a total of 65 MHz bandwidth. Although the description of the preferred embodiment is that of an antenna operating at the above frequencies, the principles of the invention are applicable at other frequencies and the invention need not be limited to a particular frequency band.

The present invention may be conceptually separated into three individual electrical parts, antenna radiator element, decoupling radiator sleeve section, and matching network. The decoupling sleeve section is considered first, and is used for dual purposes. It provides the transformation from unbalanced coaxial line to the required balanced antenna feed and it provides antenna current isolation from the radio housing. An antenna employing a decoupling radiator sleeve is commonly referred to as a sleeve dipole. A typical decoupling sleeve is shown in FIG. 5 and typically consists of a tubular conductor 502 with an antenna coax 504 centered in the sleeve 502. The center conductor 506 of the feed coax 504 extends beyond the point at which the sleeve 502 is connected to the feed coax 504 and is connected to the other element of the dipole (not shown). The tubular sleeve 502 makes up the lower half of the antenna radiator and the length dimension a is determined from the required length to cause the sleeve to be electrically resonant at the desired frequency. A second coaxial transmission line is thus formed between the sleeve 502 and the feed coax 504 and has properties determinable by familiar transmission line theory.

The RF current conducted onto the feed coax 504 outer conductor is minimized when the length a equals a quarter wavelength of the antenna operating frequency. For a wide bandwidth antenna it is desired to have this current isolation extend over a wide bandwidth, ideally across the antenna operating bandwidth. To do so, the characteristic impedance of the transmission line formed by sleeve 502 and feed coax 504 may be made larger by reactively loading the transmission line pararmeters. A high characteristic impedance results in better isolation across a wider band of frequencies. This reactive loading also decreases the physical length of the transmission line a by lowering the velocity of propagation of the electromagnetic field between inner and outer sleeve transmission line conductor.

Antennas near half-wavelength frequently use material having a high dielectric constant between inner and outer conductors 504 and 502 but this material lowers the characteristic impedance and narrows the bandwidth. For short antennas dielectric loading is less effective than that which is typically achievable with inductive loading of the inner conductor as is used in the present invention. Such an inductively loaded sleeve radiator is shown in FIG. 6. A further advantage of inductive loading advantageous to the present invention is that the decoupling bandwidth increases because the bandwidth is proportional to the square root of the inductance. Thus, inductive loading results in a factor of 2.5 increase in decoupling bandwidth in the present invention.

Inductive loading of the sleeve transmission line is accomplished by spiraling the inner conductor in the preferred embodiment. The feed coax, shown as 602 in FIG. 6, is coiled within the length a′ of 502 with a helix pitch of 0.25 inches about a diameter of 0.215 inches in the preferred embodiment. Inductive loading as described above results in a decoupling sleeve having superior radiation and decoupling properties.

The design of the radiator element for the shortened antenna of the present invention is considered next. A short antenna appears as a capacitive load to a signal generator. A simple dipole is shown in FIG. 7 in which a dipole of length M is connected to a signal generator 702. When M is less than ½ wavelength, the equivalent impedance of the antenna may be represented by a series resistor (703) - capacitor (705) network as shown. To cancel this reactance, series inductance may be added to the radiator elements as shown in FIG. 8. Here, inductance is added in each arm of the antenna (as shown by inductors 802 and 804) to reduce the length of the antenna such that the physical length M' is less than a ½ wavelength. The input impedance of the inductively loaded antenna may be modeled, now, as a series inductance 806 added to the resistive-capacitive impedance (705,703) of the dipole antenna. This added inductance 806 results in a narrower operational bandwidth of the antenna.

In concept, the inductive loading implementation is simple but in practical realization, complications arise in constructing a rugged antenna with negligible conductor losses. Basically, the approaches to loading are either distributed or lumped inductance in the radiator arms. Lumped inductance introduces a larger contribution to heating losses in the antenna resulting from large antenna current flow in the finite conductivity of the conductor. This is especially severe at higher frequencies where the apparent wire resistance increases as the result of skin effect. Distributed loading is easier to physically realize as an integral part of the radiator arms, also, the distributed inductance approach introduces negligible heating losses.

The novel antenna of the present invention utilizes a continuous spiral upper radiator and a slotted lower sleeve section. By slotting the lower sleeve section such that there is a meandering continuous current path, the distributed inductance is the result of a slow wave propagation on the sleeve and a reduced velocity of propagation. This is equivalent to increasing the electrical sleeve length (resulting in a decreased physical sleeve length). This technique is equivalent to adding a lumped inductance in the lower sleeve radiator. In the preferred embodiment of the present invention, a slot pattern in the cylindrical sleeve is realized with slots transverse to the direction of wave propagation. These slots are 0.1 inches long by 0.015 inches wide and separated from each other by 0.03 inches such that approximately 40% of the sleeve conductive material has been removed. This slotting realizes approximately a 20% increase in sleeve electrical length and a corresponding decrease in physical length.

The upper radiator is coiled for the additional series inductance needed to resonate the antenna at the desired frequency. The impedance model for the antenna of the present invention is shown in FIG. 9. The calculations of the inductance 902 value needed by the upper radiator may be calculated from the following equation (where f=frequency):

$$L_{902}=(1/(2\pi f)^2C_{705})-L_{904},$$

Where f is the desired frequency.

At high frequency, the actual inductance will be less than the calculated inductance as a result of current distribution changes within the conductor resulting from changes in frequency. The redistribution of current is such that it reduces the flux linkage at high frequency. Empirical readjustment of the antenna of the preferred embodiment results in a 6 turn helix of 0.32 inches in diameter and 1.40 inches long for an operating center frequency of 857 MHz. Antenna dimensions for other operating frequencies may be readily calculated by those skilled in the art.

To enable the antenna of the present invention to be operable over a wide bandwidth, a unique matching network is employed. The loaded shortened antenna is caused to be resonant at the center of the two frequency bands of operation utilized by the portable radiotelephone transceiver. At this center frequency, the antenna appears as a resistive load to the signal generator. In this respect it may be considered to be equivalent to a resonant half-wave antenna of full dimension. However, the shortened antenna has a higher Q with lower radiation resistance. These two properties make the shortened antenna difficult to match for relatively broad band operation. The optimum match technique employed by the antenna of the present invention employs a dual banding network to give an impedance match in two frequency bands.

The dual banding network employed in the present invention is shown in FIG. 10. Here the dual banding circuit 1000 is a parallel resonant tank consisting of capacitor 1002 and inductor 1004. The preferred embodiment of the present invention employs lumped elements to realize the desired capacitance and inductance. The proper operation of this dual banding matching circuit requires that the antenna and the dual banding circuit both resonate at the center frequency between the separate frequency bands of desired operation. The matching operation of the circuit can be understood from either a Smith chart or an equivalent circuit analysis.

Employing first the equivalent circuit approach, it can be seen that at frequencies below the bandwidth center, the matching circuit requires an inductive reactance characteristic shown as inductance 1002 in FIG. 11. At frequencies below the center frequency, the shortened antenna has a capacitive inductance characteristic shown as 1104 in FIG. 11. Reactances 1102 and 1104, with properly designed component values, constitute a two element L-match network that transforms the shortened antenna low radiation resistance 703 to a higher 50 ohm impedance to match a coaxial transmission line impedance.

FIG. 12 is a schematic diagaram of the electrical model of FIG. 10 operated at the center resonant frequency.

The radiation resistance 703 is presented to the coaxial line exxentially without reactive components.

At frequencies above the operational bandwidth center, the matching network assumes a capacitive impedance characteristic 1302 as shown in FIG. 13 and the antenna assumes an inductive impedance characteristic 1304 so that again an L-match network transforms the low radiation resistance 703 to the desired 50 ohms source impedance.

Employing a Smith chart analysis, application of L section matching theory indicates that for a match inside a 2:1 VSWR circle shown in FIG. 14, the antenna impedance below the operational band center must fall within the shaded area 1402 of FIG. 14. Antenna characteristics above the operational band center must fall within the shaped area 1404 in order to be matched with a two element L-match network to within the 2:1 VSWR match circle.

Therefore the antenna impedance must be within the indicated range of feasible match impedances for wide banding, including the frequencies of the two bands of operation. Referring again to FIG. 10, the matching technique requires that both antenna and match circuit be resonant at the center of the operating frequency bandwidth. However, this is insufficient information for choosing the values for L1004 and C1002 from the resonant condition alone:

$$w_0=(L_{1004}/C_{1002})-\tfrac{1}{2}$$

The other condition to be satisfied is that of obtaining maximum power transfer between the generator and antenna radiation resistance for the remainder of the operating bandwidth. This will occur when the transducer power gain is at a maximum. With this in mind, the relation is easily derived for match circuit capacitance given by:

$$B=(X^2+2R_{703}^2)/(X.R_{703}^2+X^3)$$

where, $C_{1002}=B.w/(w^2+w_0{}^2)$ $X=L_{1004}(w^2+w_0{}^2)/w$ w=frequency in radians/sec.

The solution to these equations give an optimum match over the frequency band of operation. On the Smith chart, the impedance will be within the specified 2:1 VSWR circle. The preferred embodiment antenna employs a $C_{1002}$ of approximately 50 pf and L1004 of approximately 0.7 nH providing a Q of approximately 70.

The electrical location of the dual band matching circuit is shown in the diagram of FIG. 15. The tuned circuit is realized at the feed point of the antenna and is coupled from the center conductor of the feed coax to the coax outer conductor and the top of the decoupling sleeve 404.

Figure 16:
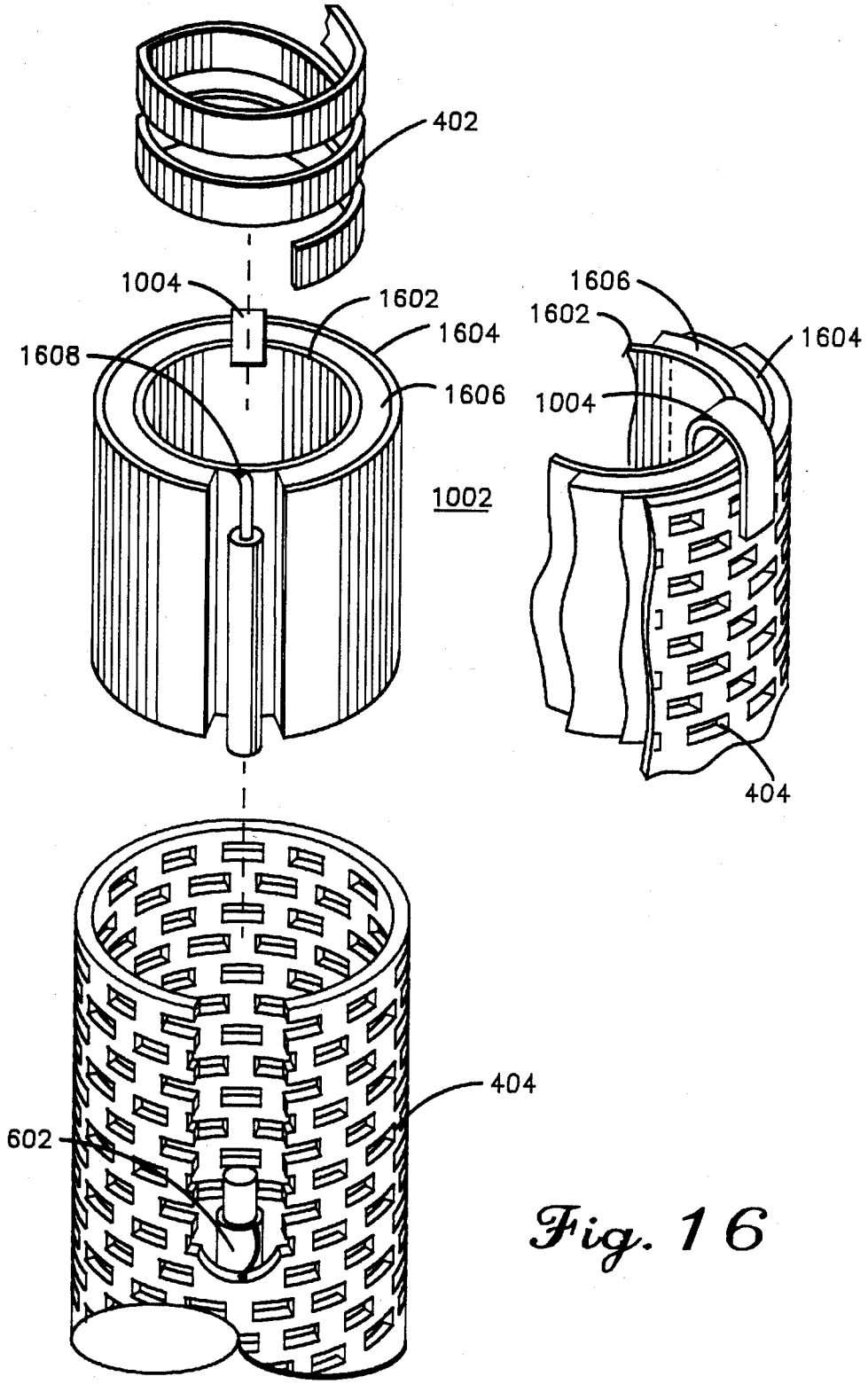
FIG. 16 is a detailed drawing of the matching network within the antenna of the present invention.

The decoupling network in the preferred embodiment is realized as shown in FIG. 16. The capacitor 1002 is essentially formed of two concentric conducting cylinders 1602, 1604 separated by a stable dielectric material 1606 with a dielectric constant of 10 such as Epislam 10 TM. A notch is cut in the outer conducting cylinder 1604 and dielectric 1606 which is parallel to the axis and running the complete length of the capacitor cylinder. The center conductor of feed coax 602 (preferably with the insulation left in place) runs the length of the slot and is attached to the inner conducting cylinder 1602 at a point 1608 near the top of the cylinder. Inductor 1004 is realized in the preferred embodiment as a strap looping from the inner cylinder 1602 to the outer cylinder 1604 at a point directly opposite to point 1608. This inductor 1004 may be formed of a strap 0.10 inches long and 0.15 inches wide. The capacitor inductor assembly fits within the decoupling sleeve 404 such that the top of the capacitive cylinder 1002 is flush with the top of the dielectric sleeve 404 and that inductor 1004 may be soldered to the outside surface of the decoupling sleeve 404. The helical upper resonator 402 is affixed to the inner capacitor cylinder 1602 at or near point 1608.

Figure 17:
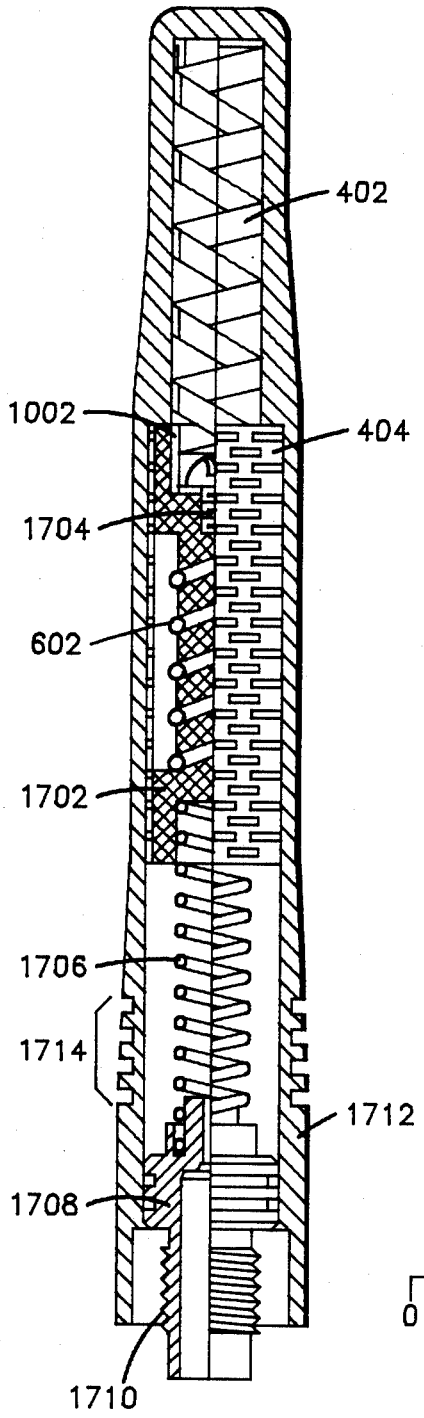
FIG. 17 is a detailed drawing of the shortened decoupled wideband sleeve dipole antenna of the present invention.

The fully assembled antenna of the present invention is shown in FIG. 17. In the preferred embodiment, the upper helically wound resonator 402 is soldered into the capacitor assembly 1002 and extends 1.785 inches above the decoupling sleeve 404. The helically wound feed coax 602 is supported by a dielectric form 1702 which is secured by a screw 1704 to cylindrical capacitor 1002 and to a flexible mounting spring 1706. The spring 1706, which is insulated from the decoupling sleeve 404 by dielectric form 1702, allows the antenna to be significantly flexible at its base to withstand mishandling. The spring is secured to a base member 1708 which further holds a female RF connector 1710 for coupling RF energy to and from the portable transceiver. Feed coax 602 extends from the feed point of the antenna (not shown) through the center of spring 1706 and coaxially connecting to connector 1710. The entire antenna assembly is surrounded by a flexible waterproof boot 1712, which in the preferred embodiment is of soft rubber, and sealed to base 1708. A series of circumferential serrations 1714 appear in the area external to the spring 1706 to allow high flexibility of the rubber boot 1712 where the antenna flexes on the spring 1706.

Figure 18:
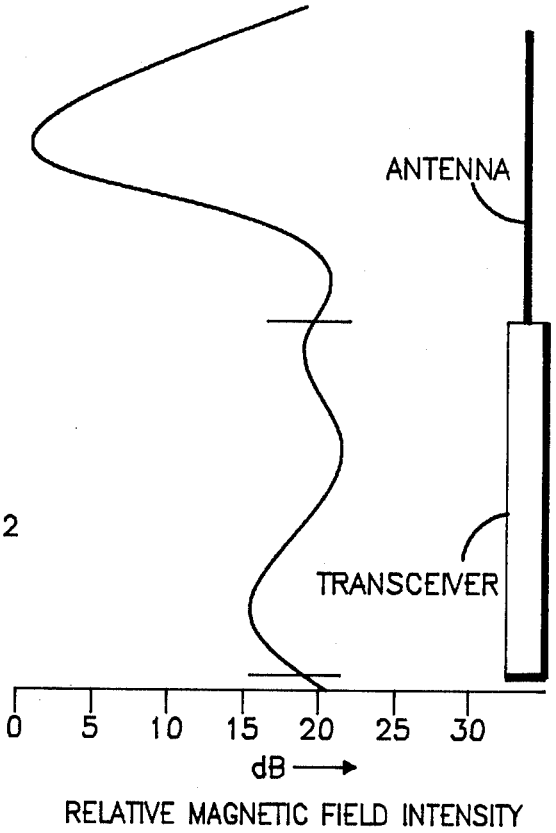
FIG. 18 is a graph showing the magnetic field intensity of a portable transmitter and the antenna of the present invention.
Figure 19:
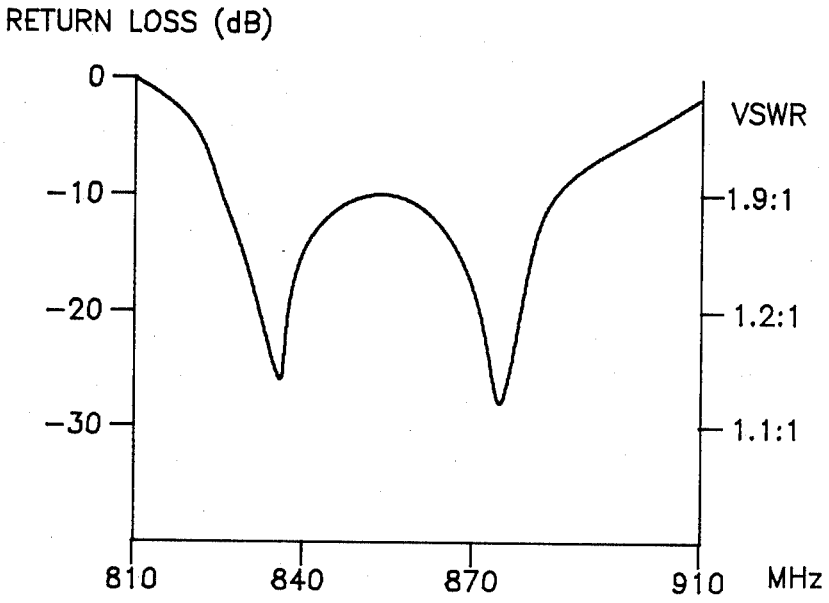
FIG. 19 is a graph showing the return loss of the antenna of the present invention.
Figure 20:
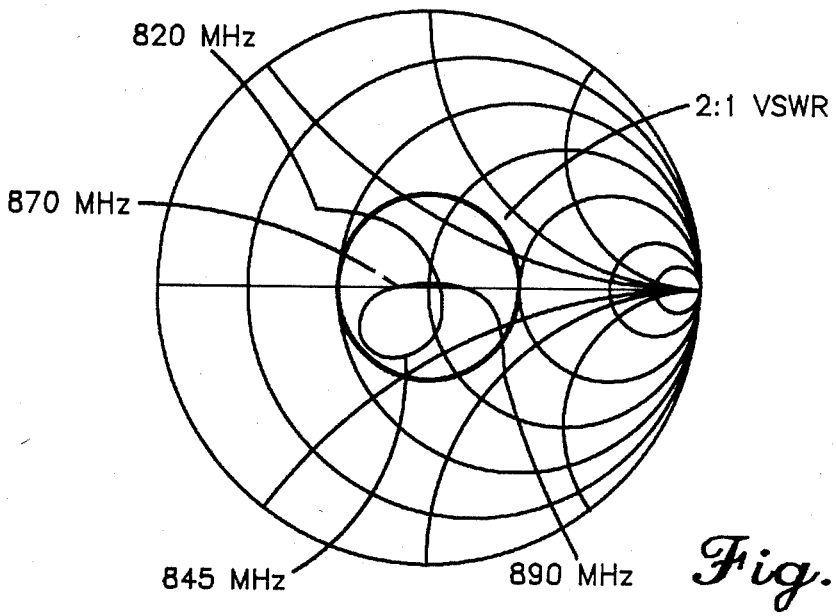
FIG. 20 is a Smith chart showing the input impedance versus frequency of the antenna of the present invention.

The decoupling sleeve 404, which in the preferred embodiment has a length of 1.53 inches with a diameter of 0.43 inches, provides effective decoupling of the antenna and portable transceiver housing as shown in FIG. 18. This Figure, like FIG. 2, illustrates the magnetic field intensity along the vertical extent of the transceiver and short antenna. It can be seen that the maximum magnetic field strength occurs near the feed point of the short antenna and RF currents in the transceiver housing are nearly 15 dB below the peak field intensity. The return loss of the antenna of the preferred embodiment is shown in FIG. 19 where it can be seen that the return loss at antenna and matching network resonance at 857 MHz is −10 dB (a VSWR of 1.9:1). At frequencies lower than the band center, the return loss improves due to the inductive matching of the matching network and at frequencies above the band center, the return loss improves due to the capacitive reactance of the matching network. The operational bandwidth of the antenna, then, is realized across the desired 65 MHz of operation. The effectiveness of this antenna may also be seen in the Smith chart of antenna impedance vs. frequency shown in FIG. 20.

Thus, a decoupled wideband shortened sleeve dipole antenna preferably for use on portable radio transceivers has been shown and described. Distributed inductive loading is incorporated in the novel antenna for physical length reduction and shortening of the decoupling sleeve. For maximum power transfer and desired far field radiation pattern, a dipole antenna is operated near resonance. An integral dual band matching network, tuned to the antenna resonant frequency is located at the antenna feed point and provides broad band performance in a physically short antenna by matching antenna impedance above and below resonance. Therefore, while a particular embodiment of the invention has been described and shown, it should be understood that the invention is not limited thereto since many modifications may be made by those skilled in the art. It is therefore contemplated to cover by the present application any and all such modifications that fall within true spirit and scope of the basic underlying principles disclosed and claimed herein.

We claim:

1. A wideband shortened decoupled sleeve dipole antenna comprising:

a helically wound first radiating element tuned to a center resonant frequency and having first and second opposing ends and a central axis;

a cylindrical second radiating element tuned to said center resonant frequency and having first and second opposing ends and a central axis, said first end of said second radiating element disposed adjacent to said first end of said first radiating element and said second radiating element central axis essentially collinear with said first radiating element central axis;

a coaxial transmission line of a predetermined impedance disposed within said second radiating element, said transmission line helically wound about said second radiating element axis, and having first and second opposing ends, the outer conductor of said coaxial transmission line at said first end coupled to said first end of said first radiating element and the inner conductor of said coaxial transmission line at said first end coupled to said first end of said first radiating element, and said second end of said coaxial transmission line, adapted to couple to an antenna utilization means, emanating from said second end of said second radiating element; and a matching network, coupled to said coaxial transmission line at said first end, tuned to said center resonant frequency, and having reactive impedance components at frequencies above and below said center resonant frequency, to substantially impedance match said coaxial transmission line impedance to the impedance of said first and second radiating elements at said center resonant frequency and at frequencies a predetermined amount above and below said center resonant frequency.

2. A wideband shortened decoupled sleeve dipole antenna in accordance with claim 1 wherein said first radiating element is further tuned to an electrical length of a quarter wavelength at said center resonant frequency.

3. A wideband shortened decoupled sleeve dipole antenna in accordance with claim 1 wherein said second radiating element is further tuned to an electrical length of a quarter wavelength at said center resonant frequency thereby decoupling the antenna from said feed coaxial transmission line.

4. A wideband shortened decoupled sleeve dipole antenna in accordance with claim 3 wherein said second radiating element is inductively loaded.

5. A wideband shortened decoupled sleeve dipole antenna in accordance with claim 1 wherein said matching network further comprises a parallel tuned circuit disposed between the inner conductor and the outer conductor of said coaxial transmission line at said first end of said coaxial transmission line.

6. A wideband shortened decoupled sleeve dipole antenna in accordance with claim 5 wherein said parallel tuned circuit further comprises a capacitor disposed within said first end of said second radiating element and comprising:

a first conductive cylinder with inner and outer surfaces, said inner face conductively connected to said first end of said first radiating element;

an insulating dielectric cylinder concentric with and enclosing the outer surface of said first condictive cylinder and having inner and outer circumferential surfaces and top and bottom ring surfaces, said insulating cylinder having a notch extending from outer to inner surfaces and from said top ring surface at least part way to said bottom ring surface, through which said coaxial transmission line inner conductor may be conductively connected to said first conductive cylinder and said first radiating element; and a second conductive cylinder with inner and outer surfaces concentric with said first conductive cylinder and said insulating dielectric cylinder and disposed at the outer surface of said insulating dielectric cylinder, said second conductive cylinder conductively connected to said second radiating element through a substantial portion of said second conductive cylinder outer surface.

7. A wideband shortened decoupled sleeve dipole antenna in accordance with claim 6 further comprising an inductive strap conductively connected to said inner surface of said first conductive cylinder and to said second radiating element.

8. A wideband shortened decoupled sleeve dipole antenna in accordance with claim 1 further comprising a spring member and a mounting base, said spring member having first and second opposing ends and insulatingly attached at said first end to said second end of said second radiating element and attached to said mounting base at said second end, thereby providing mechanical flexibility for the antenna.

9. A wideband shortened decoupled sleeve dipole in accordance with claim 1 wherein said second radiating element has a physical length shorter than a free space quarter wavelength at said center resonant frequency.

10. A dual-hand shortened decoupled sleeve dipole antenna especially adapted for duplex portable transceiver use and having two hands of frequencies at which the antenna return loss is optimized, comprising:

a helically wound first radiating element of a length producing an electrical quarter wavelength at a center frequency and having first and second opposing ends and a central axis;

a slotted cylindrical second radiating element of a length producing an electrical quarter wavelength at said center frequency and having first and second opposing ends and a central axis, said first end of said second radiating element disposed adjacent to said first end of said first radiating element and said second radiating element central axis essentially collinear with said first radiating element central axis;

a coaxial transmission line of a predetermined impedance disposed within said second radiating element and helically wound about said second radiating element axis to decouple the antenna from said coaxial transmission line, said coaxial transmission line having first and second opposing ends, the outer conductor of said coaxial transmission line at said first end coupled to said first end of said first radiating element and the inner conductor of said coaxial transmission line at said first end coupled to said first end of said first radiating element, and said second end of said coaxial transmitting line, adapted to couple to an antenna utililzation means, emanating from said second end of said second radiating element; and parallel tuned matching network, coupled between said coaxial transmission line inner conductor and outer conductor at said first end, tuned to said center frequency, and having a capacitive reactance above said center frequency and inductive reactance below said center frequency to substantially impedance match said coaxial transmission line to said first and second radiating elements at a first band of frequencies above said center frequency and at a second band of frequencies below said center frequency.

11. A dual-band shortened decoupled sleeve dipole antenna in accordance with claim 10 wherein said parallel tuned circuit further comprises a capacitor disposed within said first end of said second radiating element and comprising:

a first conductive cylinder with inner and outer surfaces, said inner surface conductively connected to said first radiating element;

an insulating dielectric cylinder concentric with and enclosing the outer surfaces of said first conductive cylinder and having inner and outer circumferential surfaces and top and bottom ring surfaces, said insulating cylinder having a notch extending from outer to inner surface and from said top ring surface at least part way to said bottom ring surface, through which said coaxial transmission line inner conductor may be conductively connected to said first conductive cylinder and said first radiating element; and a second conductive cylinder with inner and outer surfaces concentric with said first conductive cylinder and said dielectric cylinder and disposed at the outer surface of said dielectric cylinder, said second conductive cylinder conductively connected to said second radiating element through a substantial portion of said second conductive cylinder outer surface.

12. A dual-band shortened decoupled sleeve dipole antenna in accordance with claim 11 further comprising an inductive strap conductively connected to said inner surface of said first conductive cylinder and to said second radiating element.

13. A dual-band shortened decoupled sleeve dipole antenna in accordance with claim 10 further comprising a spring member and a mounting base, said spring member having first and second opposing ends and insulatingly attached at said first end to said second end of said second radiating element and attached to said mounting base at said second end, thereby providing mechanical flexibility for the antenna.

14. A dual-band shortened decoupled sleeve dipole antenna in accordance with claim 10 wherein said slotted cylindrical second radiating element further comprises a cylinder of conductive material formed with a plurality of slots therein, each said slot having at least two dimensions and each said slot disposed with the largest of said dimensions transverse to the direction of said second radiating element central axis.

* * * * *

UNITED STATES PATENT AND TRADEMARK OFFICE

CERTIFICATE OF CORRECTION

PATENT NO. : 4,730,195

DATED : March 8, 1988

INVENTOR(S) : James P. Phillips Et Al.

It is certified that error appears in the above-identified patent and that said Letters Patent is hereby corrected as shown below:

Column 11, line 15, please delete "of said first" and insert --of said second--.

Column 11, line 61, please change the word "condictive" to --conductive--.

Column 12, line 28, change the word "dual-hand" to --dual-band--.

Signed and Sealed this

Twenty-third Day of August, 1988

*Attest:*

DONALD J. QUIGG

*Attesting Officer*

*Commissioner of Patents and Trademarks*